United States Patent [19]

Buchner et al.

[11] Patent Number: 4,595,560

[45] Date of Patent: Jun. 17, 1986

[54] METHOD FOR STERILIZING PACKAGING MATERIAL AND/OR PACKAGING APPARATUS

[75] Inventors: Norbert Buchner, Winnenden; Günter Vögele, Schönaich; Bernd Wilke, Stuttgart, all of Fed. Rep. of Germany

[73] Assignee: Robert Bosch GmbH, Stuttgart, Fed. Rep. of Germany

[21] Appl. No.: 589,834

[22] Filed: Mar. 15, 1984

[30] Foreign Application Priority Data

Jul. 16, 1983 [DE] Fed. Rep. of Germany ..... 3325786

[51] Int. Cl.[4] ..... A61L 2/08

[52] U.S. Cl. ..... 422/26; 422/38; 422/302; 426/407

[58] Field of Search ..... 422/20, 21, 26, 27, 422/38, 24, 25, 28, 297, 302; 426/399, 400, 401, 407; 53/167

[56] References Cited

U.S. PATENT DOCUMENTS

| | | | |
|---|---|---|---|
| 3,291,563 | 9/1960 | Martin | 53/167 |
| 3,486,295 | 12/1969 | Rausiag et al. | 53/167 |
| 4,225,555 | 9/1980 | Fahlvik et al. | 422/26 |
| 4,315,899 | 2/1982 | Mamourian et al. | 423/321 R |
| 4,424,189 | 1/1984 | Hick | 422/28 |
| 4,533,515 | 8/1985 | Witter et al. | 422/26 |

OTHER PUBLICATIONS

Aseptic Packaging of Food, Brody 1972, Food Technology—Aug. 1972, pp. 70 & 74.

The Technology of Food and Preservation Desrosier Avi Publ. 3rd ed. 1970, pp 190–191.

*Primary Examiner*—David L. Lacey

*Assistant Examiner*—Titus B. Ledfetter, Jr.

*Attorney, Agent, or Firm*—Edwin E. Greigg

[57] ABSTRACT

A method is proposed for sterilizing packaging material of plastic, cardboard or combinations of the two, in particular for sterilizing preshaped packaging containers intended for receiving acidic products. In this method, damage to the packaging material or the packaging apparatus is to be avoided because of the mild thermal treatment involved. By subjecting the surface to be treated to a flow of a moist mixture of water vapor and air at a temperature of from 80° to 140° C. and having a moisture content of from 5 to 50%, sufficiently high degrees of sterility for the sterile packaging of acidic food products are attainable within relatively short treatment periods.

6 Claims, 1 Drawing Figure

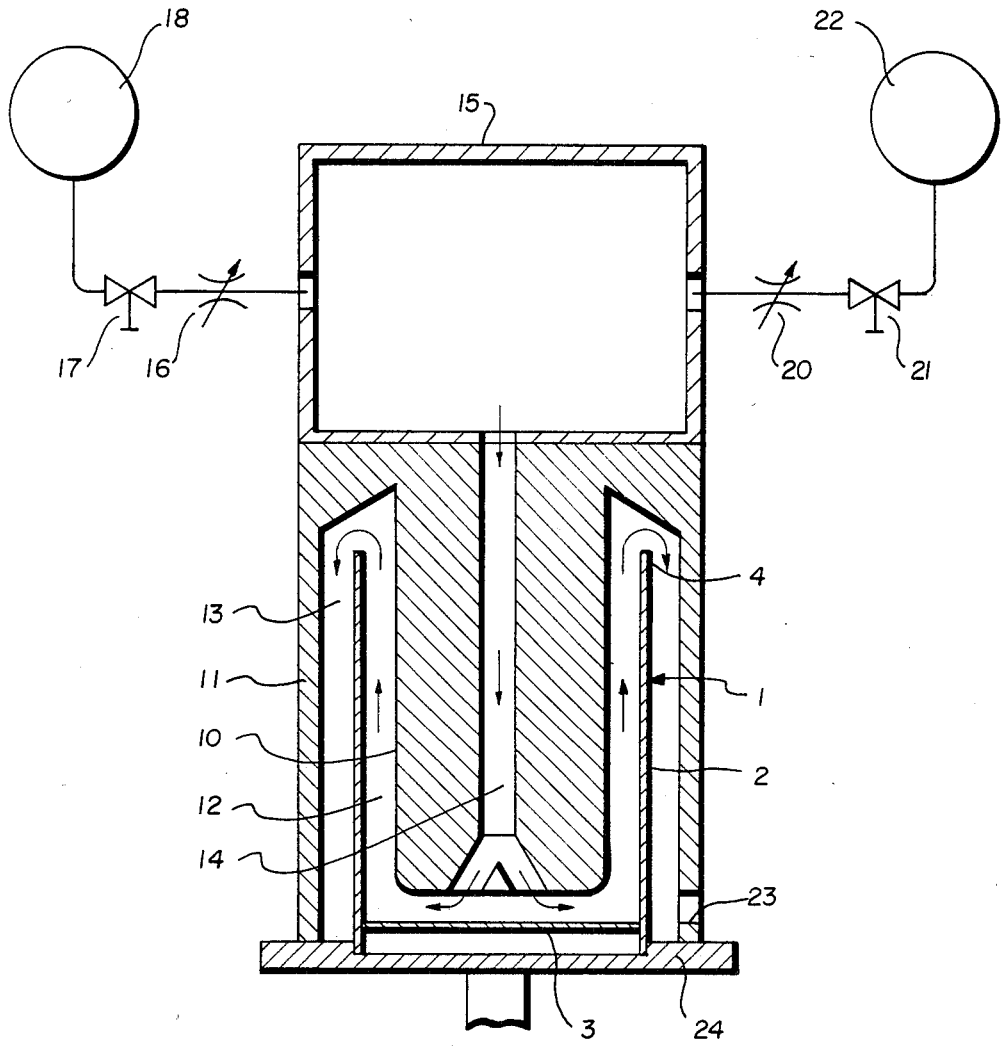
18
22
15
17
16
20
21
4
13
11
1
10
2
12
14
23
3
24

METHOD FOR STERILIZING PACKAGING MATERIAL AND/OR PACKAGING APPARATUS

BACKGROUND OF THE INVENTION

The invention is based on a method for the sterilization of packaging material or packaging apparatus.

For example, in a method known from German Patent Application Nos. DE-A 2 839 543 and DE-A 2 919 015, packaging containers, such as yogurt cups, made of molded thermosetting plastic are treated with a mixture of water vapor and air. In order to attain sufficient sterility, the cups must be heated to a temperature of at least 140° C. To this end, the mixture comprises saturated vapor at a temperature of 138° C. and air, and before use the mixture is heated to a temperature of from 250° to 275° C.

As a result of the additional heating of the mixture, this known method is substantially a dry-heat sterilizing method and works similarly to other known methods using superheated water vapor, hot gas or hot air. These known sterilizing methods do not take into account the long-known fact that microorganisms and spores have less resistance in moist heat than in dry heat. Sterilizing methods have therefore also been developed which use saturated vapor at a pressure in excess of atmospheric pressure (German Patent Application Nos. DE-A 2 519 329 and 3 031 084). These known methods have the disadvantage, however, that the packaging containers or materials to be sterilized must be treated in pressure-proof containers, which are relatively expensive and complicated to handle.

A further sterilizing method is also known in which the containers are treated with flowing water vapor at atmospheric pressure (German Patent Application No. DE-A 3 044 061). This method has the disadvantage that in packaging materials which include a layer of cardboard, moisture can get into the cut edges. The cardboard acts like a sponge, making the packaging material soft and causing difficulties in the subsequent heat-sealing operation.

Finally, in order to prevent infections from being transmitted from packaging machine apparatus and peripheral equipment to the packaging material or the packaged product, German Patent Application No. DE-A 1 642 069 teaches the sterilization of pouring and dispensing spaces, lines, valves, filters and similar parts of a packaging machine with which either the product or the surrounding air comes into contact by the use of saturated vapor at 125° C. and 2.5 bar of superatmospheric pressure before the packaging machine is put into operation. To attain a sufficient degree of sterility, this treatment is performed for a period lasting several minutes. The disadvantage here is that to accomplish this, the various parts of the equipment must be designed to withstand the superatmospheric pressure. If alternatively hot steam is used at atmospheric pressure, then much higher temperatures and/or much longer treatment periods are necessary.

Packaging materials made of plastic that have already been introduced into the packaging machines cannot tolerate such high temperature stresses over a relatively long period. They soften and stick to parts of the machine, preventing the starting of the machine. Steam condensate also stops up the air sterilizing filter (known as an HOSCH filter) that is disposed in packaging machines in order to maintain a sterile atmosphere.

A thermal sterilizing method accordingly is needed in which the thermal stress on the parts to be sterilized, in particular packaging material and sterilizer high-capacity filters, is low and which can be performed within a short period of time.

OBJECT AND SUMMARY OF THE INVENTION

A sterilization method according to the invention has proved, surprisingly, that flora having pertinence to food products with a pH value below 4.6 can be destroyed with little thermal stress and in a relatively short period at atmospheric pressure. This relatively mild thermal sterilizing method furthermore requires relatively little energy. It is particularly suitable for treating packaging containers of thermplastic materials, or materials coated therewith, for sterile packaging of acidic or high acidic food products with a pH value below 4.6, such as fruit and vegetable juices, wine and sour-milk products. Only a limited number of types of microorganisms are capable of growing in such acidic products, specifically molds, yeasts and acid-forming bacteria. These microorganisms are thermally relatively more sensitive than other bacteria. The method according to the invention can also be used for sterilizing packaging machine parts and accessories under mild conditions.

If after the actual sterilization phase per se, involving a mixture of water vapor and air, the treated surfaces of the packaging material, packaging container or machine parts are to be air dried at a temperature of from 80° to 120° C., it is particularly advantageous if the sterilizing mixture of water vapor and air is formed from hot air at the temperature of the air used for drying and saturated steam.

The invention will be better understood and further objects and advantages thereof will become more apparent from the ensuing detailed description of preferred embodiments.

BRIEF DESCRIPTION OF THE DRAWING

The FIGURE shows a cross section of the apparatus for carrying out the sterilizing method.

DESCRIPTION OF THE PREFERRED EMBODIMENTS

For aseptic packaging of acidic food products, packaging containers should be rendered free of viable germs prior to being filled and sealed. The containers are preferably made from a thermoplastic material or a multi-layered packaging material, for instance a polyethylene/cardboard/aluminum/polyethylene laminate.

To perform the method, a nozzle 10 that is surrounded by a hood 11 is introduced into the interior of an upright container 1. The nozzle 10 fills up the majority of the interior of the container and leaves a gap 12 between the side wall 2 and the bottom 3 of the container 1. The hood 11 likewise leaves a gap 13 between the upper opening rim 4 and the side wall 2 of the container 1. The nozzle 10 has a longitudinal bore 14, which branches at the lower end of the nozzle 10 and is directed toward the bottom 3 of the container 1. With its upper end, the longitudinal bore 14 of the nozzle 10 is connected to a mixing chamber 15, which communicates at one end, via an adjustable throttle 16 and a blocking valve 17, with a hot-air generator 18 and at the other end, via an adjustable throttle 20 and a blocking valve 21, with a steam generator 22. In its lower portion, the hood 11 has an outlet 23 to permit the used air-vapor mixture to escape. A platform 24 that can be raised and lowered closes off the lower opening of the hood 11.

To sterilize a container 1, the container is placed on the lowered platform 24, and the platform is then brought by a lifting movement into contact with the hood 11, so that the container is enclosed in the hood 11 and surrounds the nozzle 10. Then the two blocking valves 17 and 21 are opened for a predetermined period of time, so that hot air and water vapor flow into the mixing chamber 15, where they mix together, and the air/vapor mixture flows through the longitudinal bore 14 of the nozzle 10 toward the bottom 3 of the container 1, where it is diverted and, in contact with the inside and outside of the side wall 2 of the container, flows through the gaps 12 and 13 and also escapes through the outlet 23. The mixture ratio of the air/vapor mixture may be varied by means of the adjustable throttles 16 and 20.

Beforehand, for the sake of preheating, hot air at a temperature of from 80 degrees to 100 degrees C. is blown into the container for a period of 1.2 seconds.

In the sterilizing phase which follows, a mixture of water vapor and air at atmospheric pressure is introduced through the nozzle. The mixture is formed by the mixing of hot air at a temperature of from 80° to 120° C. with saturated steam, which during the mixing expands. The proportion of saturated steam in the mixture is from 10 to 50%. The temperature of the mixture is from 85° to 140° C., preferably from 85° to 120° C. For a period of 1.2 seconds, the mixture of water vapor and air is directed out of the nozzle toward the bottom of the container and then through the annular chamber between the nozzle and the inside of the container. To remove any remaining moisture after the sterilizing phase, sterile hot air at a temperature of from 80° to 120° C. is then introduced. This sterile hot air likewise flows through the annular chamber and has a drying effect. Instead of supplying both hot air and the mixture of water vapor and air through the same nozzle, it is also possible for a plurality of nozzles to be disposed beside one another, through which then only hot air or only the mixture is directed at a given time, with the packaging containers being moved in sequence to the various nozzles. In order to prevent reinfection of the containers, the nozzles are disposed in a chamber in which a sterile atmosphere has been established.

To test the sterilizing method described, test slides coated with mold spores were glued into place inside containers and these containers were then made to experience a flow of a mixture of water vapor and air. The duration of treatment was established at 1.2 seconds, being adapted to the indexing time of packaging machines. The slides has a diameter of 50 mm and were variously coated with approximately $10^3$, $10^5$, $10^7$ and $10^9$ germs of the following types: *Aspergillus niger, Lactobacillus lactis, Leuconostoc mesenteroides* and *Saccaromyces cerevisiae.*

It was found that when the slides or the interior wall of the container underwent a flow of the water vapor and air mixture at a temperature of merely 80° to 85° C., a pronounced germ-killing effect was already attained. At a temperature of from 90° to 100° C., the complete destruction of all the germs was ascertained.

In a first series of tests, using a water vapor and air mixture at a temperature of 95° C. and a water content of 15% by weight, the following kill rates were ascertained:

2 to 3 powers of 10 in the case of *Aspergillus niger* and *Lactobacillus lactis;*

4 to 5 powers of 10 in the case of *Leuconostoc mesenteroides;* and 6 to 7 powers of 10 in the case of *Saccharomyces cerevisiae.*

Again with the water vapor and air mixture at 95° C. but with a water content of 33%, the kill rates in the case of *Aspergillus niger* were approximately 5 powers of 10, and for the other types of germs listed the rates were higher than 7 powers of 10. At a temperature of 100° C. at a 37% water content, the kill rates for *Aspergillus niger* were higher than 7 powers of 10, and for the other three types were in fact higher than 9 powers of 10.

It is additionally noted that by preheating the packages before the sterilization phase, the amount of condensate produced during the sterilization phase can be reduced. As a result of the subsequent drying with hot air, condensate that has been produced is removed completely. In cases where a completely dry package is not required, because the slight quantities of condensate cause only a negligibly small change in the concentration of the product to be packaged therein, both the preheating and the subsequent drying operations can be dispensed with, while a good microbiological result is still attainable within the limits cited.

It has proved to be particularly advantageous in terms of the apparatus to be used for performing the method according to the invention for the hot air used for the preheating and/or subsequent drying operations to have saturated steam briefly admixed with it, for instance during a period of 1.2 seconds, in order to perform the sterilizing phase.

Finally, it should also be noted that the method described above can also be performed in the same manner for sterilizing strips or cutout patterns of packaging material from which packages are later to be made, in which case a wide-slit nozzle is for instance used.

The method according to the invention can be performed not only in order to sterilize packaging materials and packaging containers, but also, with equal success, for the pre-sterilizing of packaging apparatus and accessories, such as chambers, filling and closing apparatus, lines, filters and the like. Since these parts are less sensitive to heat and have a greater mass that must be heated, the period during which the parts are subjected to the flow of the water vapor and air mixture must be set at a longer time. What is important here is that the surfaces of the parts of the apparatus be heated to a temperature of from 70° to 100° C., in particular from 85° C. to 90° C.

To test the utility of the method, described above for the sterilizing of packaging containers, in the sterilizing of packaging apparatus as well, a test was performed with a thermally- and moisture-sensitive high-yield filter for floating substances (acronym: HOSCH filter), because such filters are used for sterilizing air or gases that are introduced into a packaging chamber in order to maintain a germ-free atmosphere. For a period of two minutes, a mixture of water vapor and air having a moisture content of 35% and at a temperature of 98° C. was directed through a HOSCH filter. The kill rate of the previously applied mold of the *Aspergillus niger* type was greater than 7 powers of 10. Similar tests showed that mixtures of water vapor and air having a moisture content of from 20 to 40% and at a temperature of from 80° to 100° C. brought about a sufficiently high degree of sterility when used for sterilizing machine parts.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A method for sterilizing surfaces of packaging material, packaging apparatus and associated equipment used in the packaging of an acidic product in order to render them free of germs capable of growing in such acidic products, comprising mixing hot air having a temperature from 80° C. to 120° C. and steam together at atmospheric pressure so as to provide a flowing moist mixture of water vapor and hot air and treating said surfaces with said flowing moist mixture of water vapor and hot air in which the mixture has a temperature of from 80° to 140° C. and a moisture content from 5 to 50%.

2. A method as defined by claim 1 in which prior to the treatment of said surfaces with the mixture of water vapor and hot air, said surfaces are preheated with flowing hot air and after the treatment, and they are subsequently dried with flowing hot air.

3. A method as defined by claim 1, in which said surfaces are pretreated with said hot air for a predetermined period of time and that following this period the hot air briefly has saturated steam admixed with it for treating said surfaces.

4. A method as set forth in claim 1 wherein said steam is saturated steam.

5. A method of sterilizing a container for an acidic product having a PH value of below 4.6 in order to render said container free of germs capable of growing in an acidic product, comprising: the steps of preheating said container by blowing hot air at a temperature of 80 degrees to 100 degrees C. into said container for a predetermined time interval, after said time interval mixing the hot air at a temperature of from 80 degrees to 120 degrees with saturated steam at atmospheric pressure to create a flowing mixture of hot air and water vapor having a temperature of 85 degrees to 140 degrees and a saturated steam content of 10 to 50% and directing said hot air and water vapor into and around said container for a predetermined time interval in a sterilization phase, and removing any moisture from the container by directing sterile hot air at a temperature of from 80 degrees to 120 degrees C. in and around said container.

6. A method according to claim 5 in which said predetermined time intervals each are approximatley at least 1.2 seconds.

* * * * *